US005143299A

United States Patent [19]

Simonetti et al.

[11] Patent Number: 5,143,299

[45] Date of Patent: Sep. 1, 1992

[54] SPRAY GUN

[75] Inventors: Sergio G. Simonetti, Westport, Conn.; Sidney J. Goodman, Paramus, N.J.

[73] Assignee: Melnor Industries, Inc., Moonachie, N.J.

[21] Appl. No.: 675,138

[22] Filed: Mar. 26, 1991

[51] Int. Cl.[5] ..... B05B 9/01

[52] U.S. Cl. ..... 239/526; 239/575; 239/583

[58] Field of Search ..... 239/526, 575, 583

[56] References Cited

U.S. PATENT DOCUMENTS

| | | | |
|---|---|---|---|
| 2,054,136 | 9/1936 | Pfaff et al. | 239/526 |
| 2,639,945 | 5/1953 | Rowlett | 239/526 |
| 2,659,628 | 11/1953 | Beach | 239/526 |
| 3,885,739 | 5/1975 | Tuttle | 239/526 |
| 4,083,497 | 4/1978 | Rosenberger | 239/526 |
| 4,214,630 | 7/1980 | Gagliardo | 239/526 |
| 4,286,734 | 9/1981 | Tonge | 239/526 |
| 4,676,437 | 6/1987 | Brown | 239/526 |
| 4,899,940 | 2/1990 | Leaver | 239/526 |
| 4,909,443 | 3/1990 | Takagi | 239/526 |
| 4,915,304 | 4/1990 | Campani | 239/526 |
| 5,020,727 | 6/1991 | Smith | 239/526 |

FOREIGN PATENT DOCUMENTS

| | | | |
|---|---|---|---|
| 2441394 | 7/1980 | France | 239/526 |

*Primary Examiner*—Andres Kashnikow

*Assistant Examiner*—Karen B. Merritt

*Attorney, Agent, or Firm*—Heiskell, Donelson, Bearman, Adams, Williams & Kirsch

[57] ABSTRACT

A spray gun for use with a source of pressurized liquid provided through a supply hose is disclosed having a body with hose connection means at the rear portion thereof and a pistol grip-style handle extending therefrom. The body has a longitudinally passageway extending from the hose connection means to the longitudinally opposed fluid dispensing end of the body. Disposed within the passageway is a plunger, slidably movable between opened and closed positions to selectively allow the dispensing of fluid through the exiting end of the body. The plunger includes a longitudinally bore partially therethrough, the rear portion of the bore being in fluid communication with the hose connections means, and radial bores providing fluid communication between the front end of the longitudinal bore and the internal passageway of the body. The trigger disposed in the handle is operatively connected to a leaver which, upon depression of the trigger, engages a pusher ring which drives the hose connection means and the plunger rearward, thereby moving the plunger from its closed to its open position. A return spring disposed in the passageway provides resistance and biases the plunger in its closed position. The trigger includes automatic locking means which must be disengaged prior to depression of the trigger.

22 Claims, 6 Drawing Sheets

SPRAY GUN

BACKGROUND OF THE INVENTION

1. Field

The present invention relates to a liquid dispensing gun and, more particularly, to a dispensing gun for use primarily with a source of pressurized liquid and connected to said source through a supply hose.

2. Description of the Prior Art

Spraying devices known in the art are commonly used for dispensing liquid chemicals for residential gardening and lawn care. Typical sprayers for such applications include a body with a pivotable handle, wherein the user presses the handle against the body to initiate spraying action, the handle being operatively connected to a valve within the body. Either the valve and/or the handle is typically spring loaded, so that the fluid flow is interrupted upon releasing the handle.

Conventional sprayers do not provide for a high degree of accuracy when aiming the direction of the spray, since the body tends to pivot in one direction as the handle is pivoted in the other. Unless the user is extremely careful to hold the body steady while depressing the lever, the liquid will not be sprayed precisely as originally aimed. In the majority of instances, this is not a serious problem. However, when certain chemicals are used, it becomes critical to hit only the desired target area in order to avoid any detrimental effects to the surrounding area.

Prior art sprayers typically include a flexible hose permanently attached to a fluid inlet portion thereof. It has been found that such hoses frequently become coiled and/or kinked, thereby necessitating the rotation of the sprayer or the liquid container in order to remove undesirable kinks. This situation is especially troublesome during colder weather, when rubber hoses tend to stiffen, becoming much more difficult to uncoil. Such coils effectively reduce the length of the hose, while kinks prevent any fluid flow through the hose; accordingly, both coils and kinks are highly undesirable.

Conventional sprayers typically do not include any type of safety means for preventing unintended spraying or use by children. Sprayers of this type typically include a locking device to hold them in the "spray" or "on" position, but no corresponding device to lock them in the "off" position.

BRIEF SUMMARY OF THE INVENTION

An object of the present invention is to provide an improved spray gun having a unique valve and actuation mechanism which overcomes the disadvantages of prior art sprayers. The novel features of the present invention provide for a sprayer which can be accurately aimed and actuated by the user, with the actuating mechanism being particularly well suited for including a safety latch.

Another object of the present invention is to provide a spray gun having a unique swiveling hose connector, to prevent unwanted coiling and/or kinking of the fluid supply hose.

A further object of this invention is to provide a spray gun composed of relatively simple components, thereby providing a reliable and economical replacement for conventional sprayers.

A still further object of this invention is to provide a spray gun having a trigger operated valve mechanism having a uniquely comfortable and natural feeling operation and movement.

In accordance with the teachings of the present invention, there is disclosed herein a preferred embodiment of a spray gun to be used primarily with a tank or other source of pressurized liquid, with a supply hose connecting the container to the spray gun. In the preferred embodiment, the spray gun of the present invention includes a pistol style grip and a trigger actuated valve. The trigger includes a safety latch which must be depressed prior to operation. The body of the preferred spray gun has a longitudinal passageway with a plunger slidably disposed therein. The rear of the body includes a swivelable hose connector for attachment to the liquid supply hose.

In the preferred embodiment disclosed herein, the front end of the plunger cooperates with the front end of the body to form a valve, with the end of the plunger forming a seal within the end of the passageway which serves as a seat. The back end of the plunger is engaged in the hose connector assembly, so that the plunger and hose connector slide together as a unit. The back end of the plunger also includes a longitudinal opening to allow fluid supplied by the hose to pass through a hollow portion of the plunger and outwardly through centrally located radial openings.

Actuation of the trigger in the preferred embodiment of this invention pivotally moves a lever engaging a pusher ring, which, in turn, engages the hose connector assembly. Rearward movement of the hose connector assembly causes the plunger to move rearwardly, thereby unsealing the front end of the passageway through the body and allowing fluid to exit therefrom. A wand of any suitable length or configuration may be attached to the front end of the body to direct the flow of fluid as intended by the user.

The trigger on the preferred embodiment includes an integrally formed latch member which automatically operates to catch a portion of the handle, thereby preventing operation of the spray gun. In order to move the trigger, it is necessary for the user to first depress the safety latch and hold the latch with one finger while depressing the trigger with another. Upon release of the trigger, the safety latch automatically repositions itself in the locked position.

These and other objects of the present invention will become apparent from the reading of the following specification, taken in conjunction with the enclosed drawings.

DETAILED DESCRIPTION OF THE PREFERRED EMBODIMENT

Figure 1:
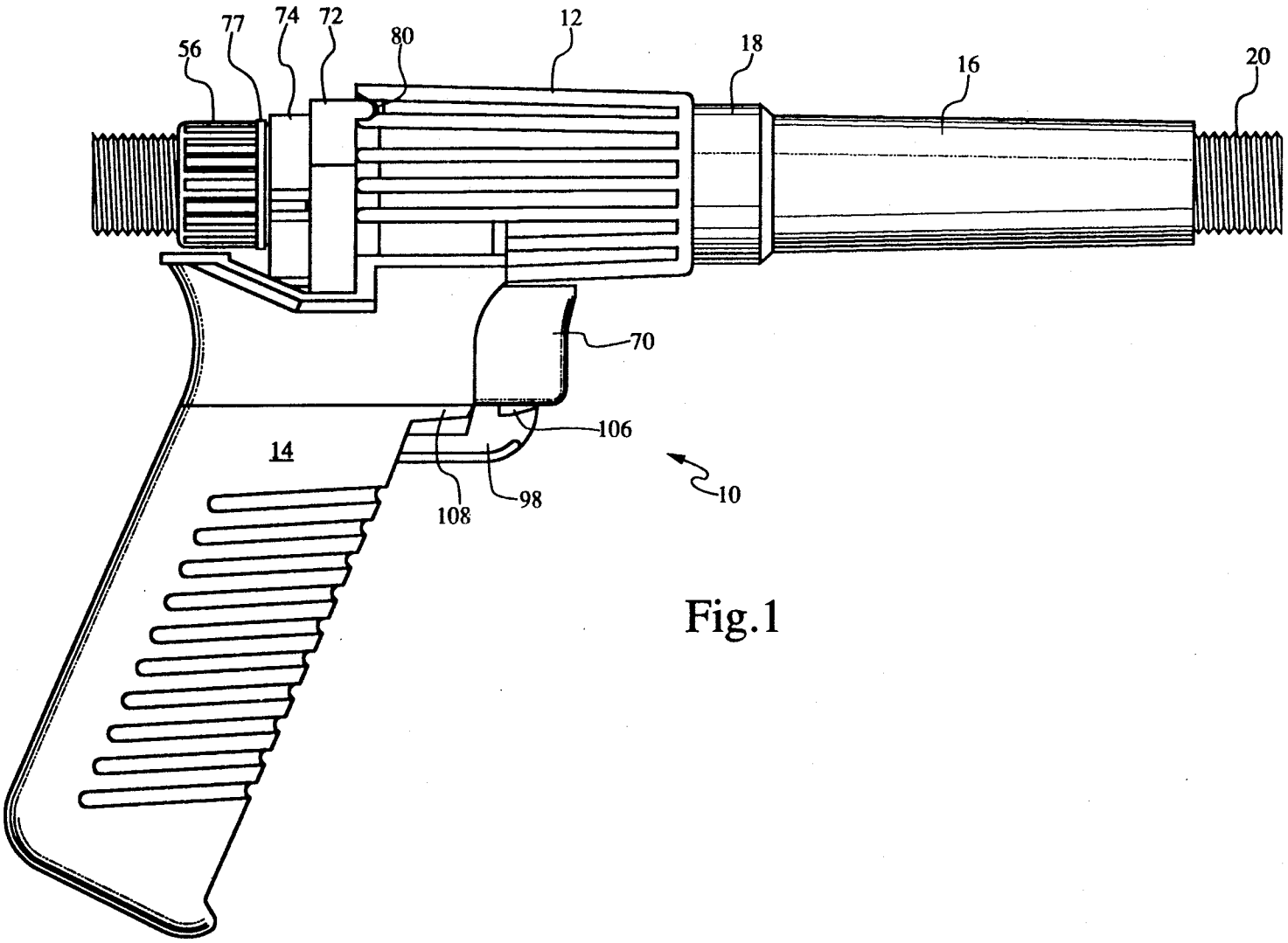
FIG. 1 is a right side elevational view of the spray gun of the present invention.
Figure 2:
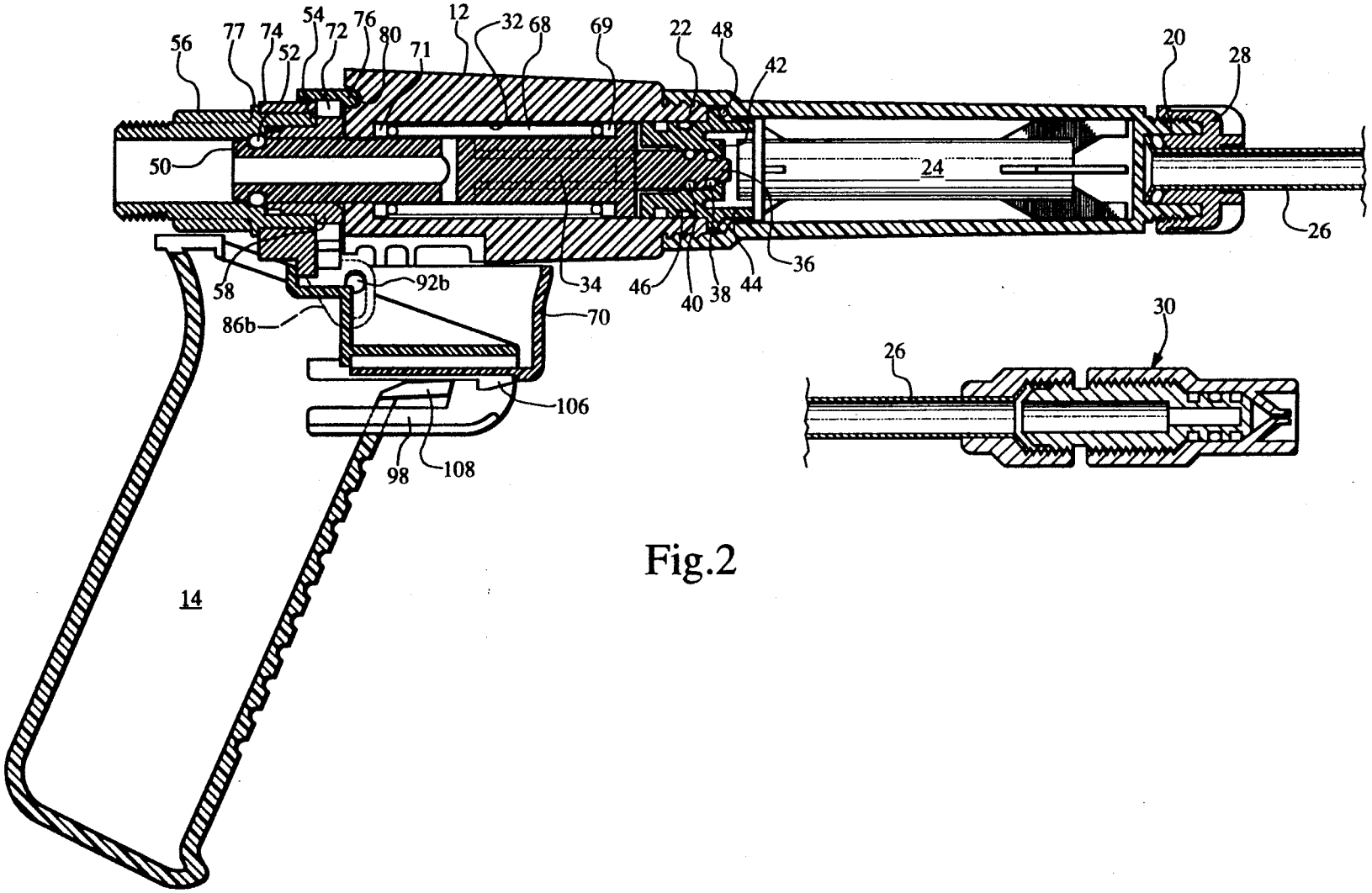
FIG. 2 is a right side sectional view of the preferred embodiment of the present invention, with the trigger released and the plunger in its closed position.
Figure 3:
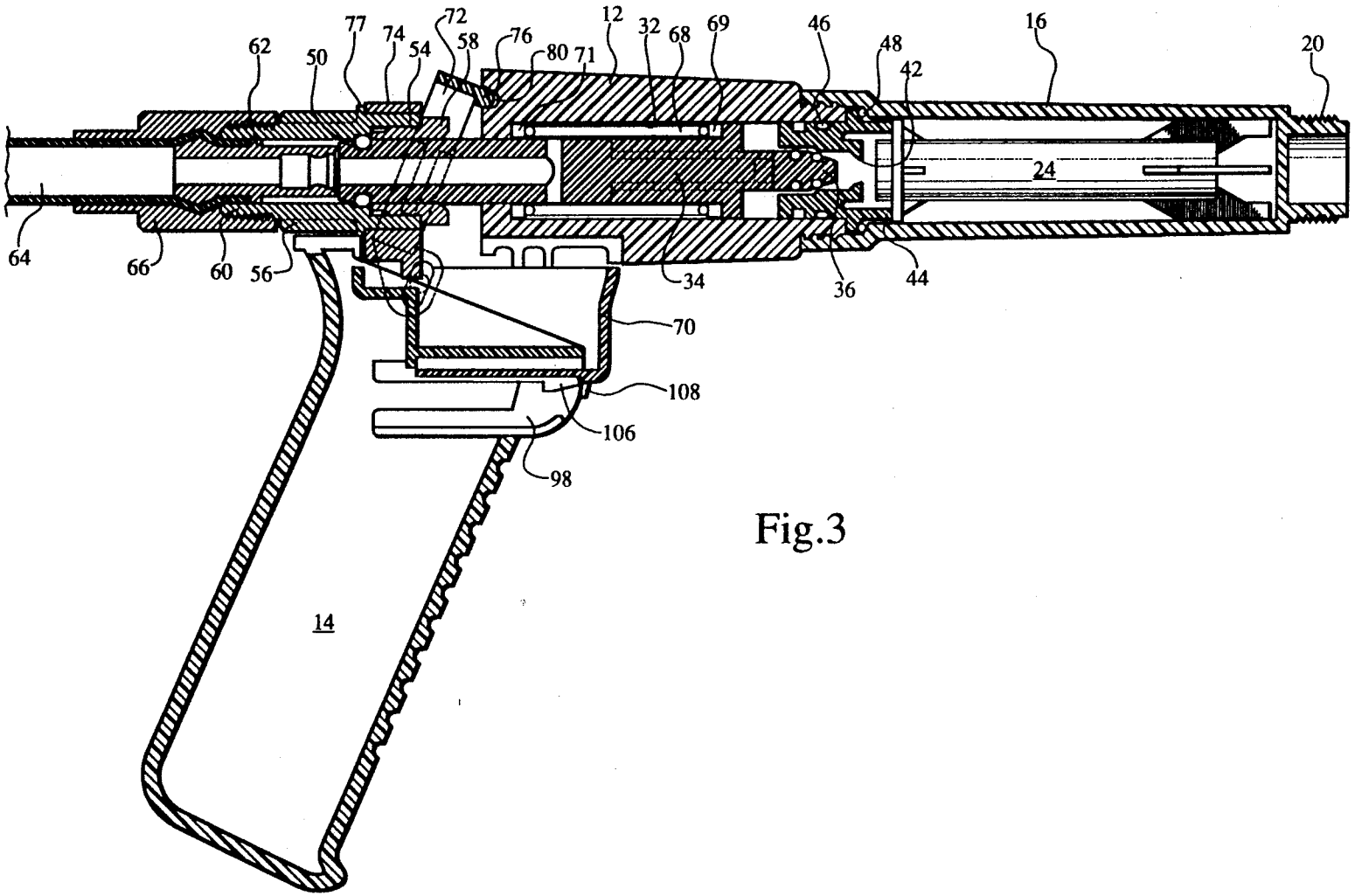
FIG. 3 is a right side sectional view of the preferred embodiment of the present invention, with the trigger depressed and the plunger in its fully open position, and with the supply hose attached.

Referring initially to FIGS. 1 and 2, the preferred embodiment of spray gun 10 comprises body 12 secured to handle 14 which serves as a pistol grip-style handle for spray gun 10. Wand body 16, having a female end 18 and male end 20, is threadingly engaged with the discharge end 22 of body 12, as best shown in FIGS. 2 and 3. Contained within wand body 16 is filter 24, which is of conventional design and construction and serves to remove particulate matter from the fluid passing therethrough.

Also shown on FIG. 2 is wand tube 26 conventionally secured to male end 20 of wand body 16 by means of retaining nut 28, which operates in a conventional manner to direct the flow of fluid through nozzle 30 which, as will be fully understood by those skilled in the art, includes conventional means for adjusting the flow of fluid dispensed therefrom. It will also be appreciated that wand tube 26 may any suitable length, and may be either straight or angled as desired to provide for accurate dispensing of fluid.

As best shown in FIGS. 2 and 3, a longitudinal passageway 32 is formed within body 12, with plunger 34 slidably disposed therein. Tapered end 36 of plunger 34 includes provisions for o-rings 38 and 40, and is configured to engage and form a fluid-tight seal with orifice 42 of adapter 44 disposed in discharge end 22 of body 12. In the preferred embodiment shown, adapter 44 is held in place by wand body 16, and includes o-rings 46 and 48 to prevent unwanted leakage.

Open end 50 of plunger 34 also includes an o-ring 52, and is secured within female end 54 of hose adapter 56 by means of swivel adapter 58. As shown in FIG. 3, the male end 60 of adapter 56 is configured to receive connector 62 which is operatively embedded in the discharge end of supply hose 64. With connector 62 in place as shown, supply hose 64 is removably securable to spray gun 10 by threadingly engaging hose clamp 66 onto male end 60 of adapter 56 as shown.

With plunger 34 operatively disposed within passageway 32 and assembled with adapter 56, swivel adapter 58, and hose clamp 66 as described above and as illustrated in FIG. 3, plunger 34, adapter 56, swivel adapter 58, connecter 62, supply hose 64, and hose clamp 66 all move longitudinally as a unit, with resistance to rearward movement being provided by compression spring 68. The leading and trailing ends of spring 68 include washers 69 and 71, respectively, as bearing surfaces. Plunger 34 is ordinarily biased in the closed position by the force generated by spring 68, with o-rings 38 and 40 forming a seal within orifice 42 as shown in FIG. 2.

Figure 4:
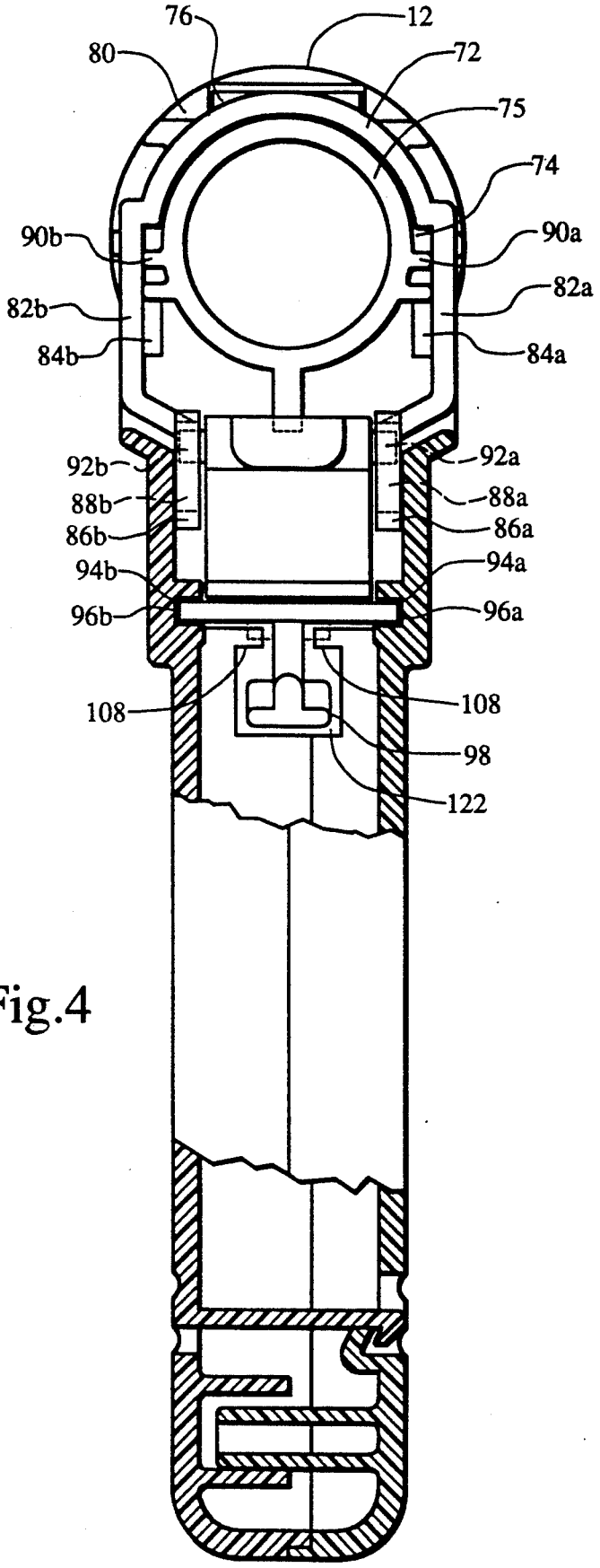
FIG. 4 is a rear view of the preferred embodiment of the preferred embodiment of the present invention, partially in section and partially disassembled.
Figure 5:
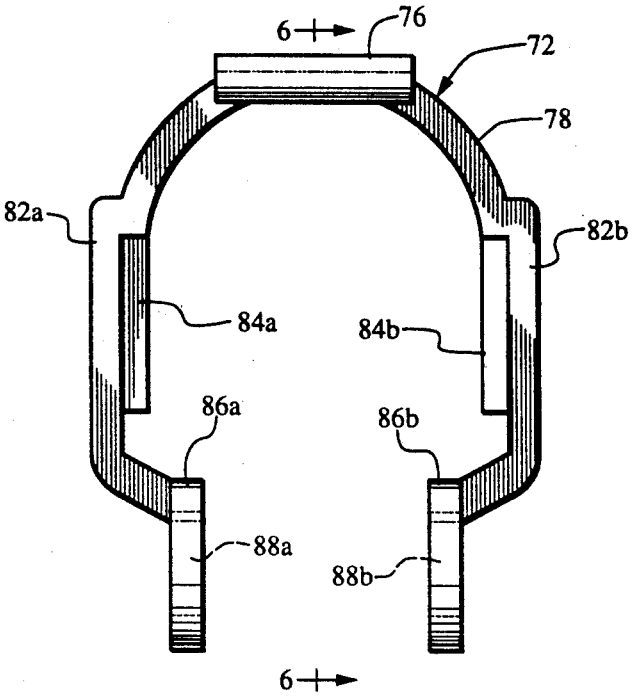
FIG. 5 represents the front elevational view of the lever mechanism of the present invention.
Figure 6:
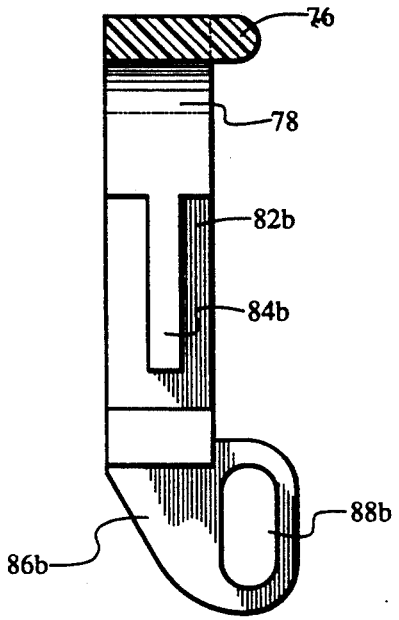
FIG. 6 is a sectional view of the lever mechanism taken along line 6—6 of FIG. 5.
Figure 7:
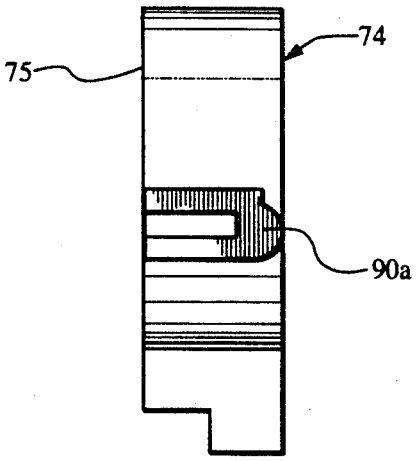
FIGS. 7 and 8 represent right side and front elevational views, respectively, of the pusher ring mechanism of the present invention.
Figure 8:
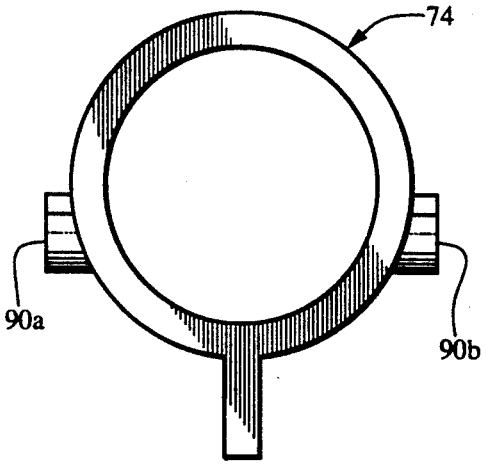

Lever 72 includes a bearing member 76 projecting from the semi-circular upper portion 78. During normal operation of spray gun 10, bearing member 76 is pivotally disposed in groove 80 formed in body 12. Generally vertical side portions 82*a* and 82*b* of lever 72 include inwardly projecting ribs 84*a* and 84*b*. The distal ends of side portions 82*a* and 82*b* are indented inwardly, as shown in FIGS. 4 and 5, and include longitudinally offset arms 86*a* and 86*b* with oblong holes 88*a* and 88*b* formed therethrough.

Pusher ring 74 is configured to fit within the bore of lever 72, so that the leading edge of ears 90*a* and 90*b* bears on the back surface of ribs 84*a* and 84*b*, respectively. The rear surface 75 of pusher ring 74 abuts annular ridge 77 of hose adapter 56 for proper operation of spray gun 10, as set forth more fully below. The interior of pusher ring 74 is configured to receive the female end 54 of hose adapter 56 in a manner allowing relatively free rotation of hose adapter 56, thereby preventing the unwanted coiling of supply hose 64.

Figure 13:
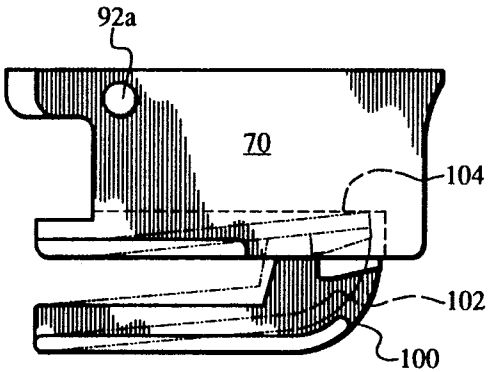
FIG. 13 is a side elevational view of the trigger of the present invention, showing the locking mechanism in both raised and lowered positions.
Figure 12:
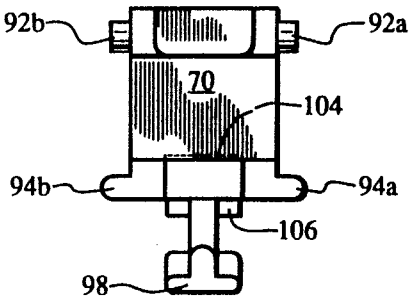
FIG. 12 is a rear elevational view of the trigger of the present invention.

Trigger 70 includes generally cylindrically shaped members 92*a* and 92*b* projecting laterally therefrom, configured to be slidably disposed within holes 88*a* and 88*b*, respectively. Extending laterally from the lower rear portion of trigger 70 are guides 94*a* and 94*b*, configured to be slidably disposed within slots 96*a* and 96*b*, respectively, formed in the interior sides of handle 14 as shown in FIG. 4. The lower surface of trigger 70 includes safety latch 98 which is movable between locked position 100 and unlocked position 102 as shown in FIG. 13. Cavity 104 is formed within the interior of trigger 70 for receiving latch 98 when moved to unlocked position 102. Catch 106 is formed in the upper surface of latch 98 and serves to engage edge portion 108 of handle 14 when trigger 70 in its locked position 100, thereby preventing rearward movement of trigger 70 unless safety latch 98 is raised to unlocked position 102. While it is preferred that the body of trigger 70 and safety latch 98 be integrally molded as a single unit, it is also expected that they may be formed as separate components and connected by conventional means.

The preferred operation of spray gun 10 is described as follows: The user grasps handle 14 in a normal pistol gripping manner, with the index finger resting on the front surface of trigger 70. Using the middle finger of the grasping hand, the user raises safety latch 98 into its unlocked position 102, and squeezes to depress trigger 70. The engagement of members 92*a* and 92*b* with arms 86*a* and 86*b* translates rearward longitudinal movement of trigger 70 into pivotal movement of lever 72 about the line of engagement between bearing member 76 and groove 80. Ribs 84*a* and 84*b* then engage ears 90*a* and 90*b* to translate the pivotal movement of lever 72 into linear, longitudinal movement of pusher ring 74. Pusher ring 74, in turn, pushes against annular ridge 77 to force hose adapter 56 rearwardly, causing plunger 34 to also move rearwardly against the pressure of spring 68. This process unseats tapered end 36 of plunger 34 from orifice 42, thereby allowing the passage of pressurized fluid through body 12 into wand body 16 and wand tube 26, and outward through nozzle 30. Upon the release of trigger 70 by the user, spring 68 returns plunger 34 and, consequently, all other components, to the closed position as shown in FIG. 2.

As mentioned above, nozzle 30 comprises conventional means for adjusting the flow of fluid dispensed by spray gun 10, preferably including both the flow rate and the spray pattern. It is also intended that the flow rate may be controlled to some degree by the extent of actuation of trigger 70. As an additional safety feature, the preferred embodiment shown and described herein incorporates a relatively deep longitudinal orifice 42 and two o-rings 38 and 40, thereby allowing trigger 70 to be depressed slightly without opening the passageway through orifice 42. Further incremental rearward movement of trigger 70 opens the passageway and increases the flow rate in similar increments.

Due to the unique features of this invention, spring 68 may be relatively light-weight, so that little effort is required to depress and hold trigger 70. Additionally, the motion of trigger 70 is linear and generally parallel to the longitudinal axis of wand tube 26. These characteristics enable the user of spray gun 10 to dispense liquids with greater accuracy and less fatigue than possible with known prior art devices.

FIG. 4 illustrates the operative relationship of trigger 70, lever 72, pusher ring 74, and handle 14, as viewed from the rear of spray gun 10. From this view it may be readily understood that trigger 70 is retained within handle 14 by means of guides 94*a* and 94*b* slidably disposed in slots 96*a* and 96*b*. Generally square opening 122 is formed in the front surface of handle 14 to provide a passageway for safety latch 98 into the interior of handle 14.

Figure 9:
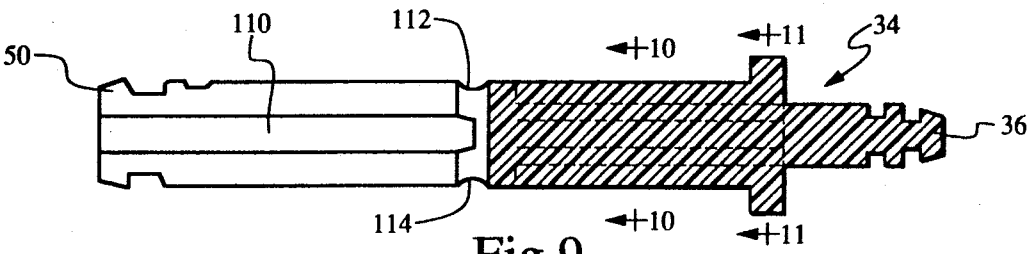
FIG. 9 is a side cross-sectional view of the plunger of the present invention.
Figure 11:
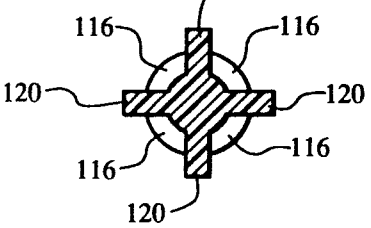
FIG. 11 is a sectional view of the plunger taken along line 11—11 of FIG. 9.
Figure 10:
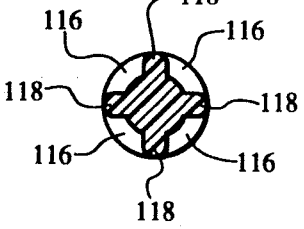
FIG. 10 is a sectional view of the plunger taken along line 10—10 of FIG. 9.
Figure 14:
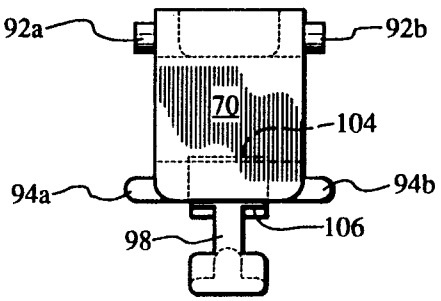
FIG. 14 represents a front elevational view of the trigger of the present invention.

As shown in FIGS. 9 through 11, plunger 34 has formed therein a longitudinal bore 110 extending from open end 50 to a generally central portion of plunger 34. In the preferred embodiment shown, the central portion of plunger 34 also includes diametrically opposed radial bores 112 and 114 which provide fluid communication between bore 110 and internal passageway 32 of body 12. With plunger 34 in the open position shown in FIG. 3, the flow of fluid provided by supply hose 64 through passageway 32 of body 12 is facilitated by voids 116 separated and partially defined by blades 118. Integrally formed radial tips 120 on blades 118 serve to guide plunger 34 as it moves within passageway 32, thereby maintaining the generally axially centered placement of plunger 34 within passageway 32.

While the principal of the above-described spray gun 10 has been made clear, it will be immediately apparent to those skilled in the art that there are many possible modifications to the disclosed embodiment without departing from the basic spirit of the present invention. Accordingly, the following claims are intended to cover and embrace not only the specific embodiment disclosed herein, but also such modifications within the spirit and scope of this invention.

What is claimed is:

1. A spray gun, for use primarily with a source of pressurized liquid provided through a supply hose, said spray gun comprising:

a body having first and second open end portions with an internal passageway extending therebetween;

hose connection means disposed longitudinally generally adjacent said first end portion of said body, suitable for receiving said supply hose;

a plunger, having an open end and a sealing end, slidably disposed within said passageway in said body and movable between open and closed positions, said plunger having a longitudinal bore formed partially therethrough, said longitudinal bore extending between said open end and a generally central portion of said plunger, said plunger including at least one radial bore extending through a wall thereof at said central portion, said radial bore providing fluid communication between said longitudinal bore and said internal passageway of said body, said open end of said plunger extending rearwardly from said first open end portion of said body and secured to said hose connection means, whereby said supply hose is maintained in fluid communication with said longitudinal bore of said plunger, and said sealing end of said plunger being configured to seal said second open end portion of said body when said plunger is in said closed position, thereby preventing the outward flow of said liquid through said second end portion, and allow the outward flow of said liquid when said plunger is in said open position;

handle means secured to said body for providing a gripping region by which the user can hold and aim said spray gun; and operating means associated with said handle means for allowing the user to selectively move said plunger between said open and closed positions, a first portion of said operating means being configured for engagement with one or more of the user's fingers, and a second portion of said operating means being operative to longitudinally slide said plunger between said open and closed positions in response to movement of said first portion of said operating means.

2. A spray gun as defined in claim 1, further comprising:

safety means, associated with said operating means and said handle means and having a latch member movable between locked and unlocked positions, for preventing movement of said first portion of said operating means when said latch member is in said locked position.

3. A spray gun as defined in claim 2, wherein:

said latch member is normally biased in said locked position, and said latch member is disposed on said first portion of said operating means whereby the user of said spray gun can move said latch member to said unlocked position with a portion of the hand holding said handle means while the user is holding said spray gun in its normal operating position.

4. A spray gun as defined in claim 1, further comprising:

means disposed within said body for biasing said plunger in said closed position.

5. A spray gun as defined in claim 4, wherein said biasing means comprise a compression spring.

6. A spray gun as defined in claim 1, further comprising:

a wand tube assembly secured to said second open end portion of said body for directing the outward flow of said liquid when said plunger is in said open position.

7. A spray gun as defined in claim 6, wherein said wand tube assembly includes a filter cartridge for filtering said liquid, said filter cartridge having a replaceable filter element contained therein.

8. A spray gun as defined in claim 1, wherein:

said handle means comprise a pistol-style grip secured to said body adjacent said first open end portion and extending generally radially therefrom.

9. A spray gun as defined in claim 1, wherein said operating means comprise:

a trigger element slidably mounted within said handle means, having a first end disposed outside and forward of said handle means and a second end disposed inside said handle means, said first end being adapted for engagement by one or more of the user's fingers;

a lever, having an upper portion pivotally engaged with said first end of said body at an area above said internal passageway, an intermediate portion bearing on at least a portion of said hose connection means, and a lower portion engaged with said second end of said trigger element, whereby rearward linear movement of said trigger element causes corresponding linear movement of said lower portion of said lever, resulting in the pivotal movement of said lever about the engagement area with said body and the generally linear rearward movement of said hose connection means, thereby moving said plunger from said closed position to said open position.

10. A spray gun as defined in claim 9, wherein:

said hose connection means include a ring-shaped member having annular inner and outer surfaces and generally planar front and rear faces, said outer surface of said ring-shaped member having at least one appendage extending generally radially therefrom, said at least one appendage being configured to engage a portion of said intermediate portion of said lever;

said hose connection means further include an adapter for threadingly engaging an attachment device provided on said supply hose, a forward portion of said adapter being disposed within said ring-shaped member, said adapter having a bearing surface configured to engage said rear face of said ring-shaped member; and said open end of said plunger is retained within said adapter; whereby said pivotal movement of said lever results in the rearward linear movement of said ring shaped member and said adapter, thereby moving said plunger from said closed position to said open position.

11. A spray gun as defined in claim 1, wherein said hose connection means include a swivel adapter to allow rotational movement of said supply hose relative to said body.

12. A spray gun as defined in claim 1, wherein:

said sealing end of said plunger comprises a generally tapered member having seal means disposed thereon; and said second open end of said body comprises a generally tapered orifice configured to received said tapered member and engage said seal means in a fluid tight relationship when said plunger is in said closed position, thereby preventing the outward flow of liquid through said second open end.

13. A spray gun as defined in claim 12 wherein said seal means comprise an o-ring.

14. A spray gun as defined in claim 12, wherein said seal means comprise a plurality of o-rings.

15. A spray gun for use primarily with a source of pressurized liquid, said spray gun comprising:

a body, having an inlet and an outlet disposed at generally opposite ends thereof with an internal passageway therebetween;

a handle secured to said body, configured for gripping by a user of said spray gun;

a trigger operatively disposed on said handle and configured for operation by the user's finger;

a plunger, having an open end and a sealing end, slidably disposed within said passageway of said body and longitudinally movable between open and closed positions, said open end of said plunger extending rearwardly from said inlet and being maintained in fluid communication with said source of pressurized liquid, said plunger having an internal passageway extending from said open end to a generally central portion thereof, providing fluid communication between said open end and said internal passageway of said body, said sealing end of said plunger being configured to allow outward passage of fluid through said outlet when said plunger is in said open position, and prevent the outward passage of fluid through said outlet when said plunger is in said closed position; and linkage means for operatively connecting a portion of said trigger to said plunger so that operation of said trigger moves said plunger between said open and closed positions.

16. A spray gun as defined in claim 15, further comprising spring means for biasing said plunger toward said closed position.

17. A spray gun as defined in claim 15, further comprising:

safety means, associated with said trigger and said handle and having a latch member movable between locked and unlocked positions, for preventing operation of said trigger when said latch member is in said locked position.

18. A spray gun as defined in claim 15, further comprising:

a wand tube assembly secured to said outlet of said body for directing the outward flow of liquid when said plunger is in said open position.

19. A spray gun as defined in claim 18, wherein said wand tube assembly includes a filter cartridge for filtering said liquid, said filter cartridge having a replaceable filter element contained therein.

20. A spray gun as defined in claim 15, wherein:

said sealing end of said plunger comprises a generally tapered member having seal means disposed thereon; and said outlet comprises a generally tapered orifice configured to receive said tapered member and engage said seal means in a fluid tight relationship when said plunger is in said closed position, thereby preventing the outward flow of liquid through said outlet.

21. A spray gun as defined in claim 20, wherein said seal means comprise an o-ring.

22. A spray gun as defined in claim 20, wherein said seal means comprise a plurality of o-rings.

* * * * *